US007048829B2

(12) United States Patent
Heger et al.

(10) Patent No.: US 7,048,829 B2
(45) Date of Patent: May 23, 2006

(54) PAPER MAKING WIRE CLOTH

(75) Inventors: Wolfgang Heger, Nideggen (DE); Klaus Fichter, Juchen (DE)

(73) Assignee: Andreas Kufferath GmbH & Co. KG, Düren (DE)

( * ) Notice: Subject to any disclaimer, the term of this patent is extended or adjusted under 35 U.S.C. 154(b) by 0 days.

(21) Appl. No.: 10/312,446

(22) PCT Filed: Mar. 29, 2001

(86) PCT No.: PCT/EP01/03574

§ 371 (c)(1),
(2), (4) Date: Dec. 27, 2002

(87) PCT Pub. No.: WO02/00996

PCT Pub. Date: Jan. 3, 2002

(65) Prior Publication Data

US 2004/0020621 A1 Feb. 5, 2004

(30) Foreign Application Priority Data

Jun. 29, 2000 (DE) ..... 100 30 650

(51) Int. Cl.
*D21F 1/10* (2006.01)
*D06D 3/04* (2006.01)

(52) U.S. Cl. ..... 162/348; 162/902; 162/903; 139/383 A; 139/425 A; 8/142; 442/205; 442/207

(58) Field of Classification Search ..... 162/202, 162/203, 211, 348, 358.2, 900–904; 139/383 A, 139/383 AA, 425 A; 28/110, 142; 442/203–208, 442/239

See application file for complete search history.

(56) References Cited

U.S. PATENT DOCUMENTS

| | | | | |
|---|---|---|---|---|
| 4,605,585 | A | 8/1986 | Johansson | |
| 4,739,803 | A * | 4/1988 | Borel | 139/383 A |
| 5,092,372 | A * | 3/1992 | Fitzka et al. | 139/383 A |
| 5,152,326 | A * | 10/1992 | Vohringer | 139/383 A |
| 5,564,475 | A * | 10/1996 | Wright | 139/383 A |
| 5,826,627 | A * | 10/1998 | Seabrook et al. | 139/383 A |
| 5,865,219 | A * | 2/1999 | Lee et al. | 139/383 A |
| 5,881,764 | A * | 3/1999 | Ward | 139/383 A |
| 6,334,467 | B1 * | 1/2002 | Barrett et al. | 139/383 A |

FOREIGN PATENT DOCUMENTS

| | | |
|---|---|---|
| DE | 4229828 | 3/1994 |
| EP | 432413 | 6/1994 |

* cited by examiner

*Primary Examiner*—Eric Hug
(74) *Attorney, Agent, or Firm*—Roylance, Abrams, Berdo & Goodman, L.L.P.

(57) ABSTRACT

A papermaking wire cloth, especially for the sheet forming zone, includes a paper side (12) and a backing side (14). The wire cloth is formed out of at least one type of transverse threads (16, 18) which are interwoven with at least one type of longitudinal threads (20). The threads together form repeats (A-H) and at least two different types of crossing (22, 24). The longitudinal threads (20) are alternated within the respective repeat (A-H) on the backing side (14), forming the other type of intersection (24). The transverse threads (18) on the backing side (14) are held on their outer side (26) which faces the paper side (12), by at least two longitudinal threads (20) within the repeat (A-H) on the backing side (14). Maximum fibre support is achieved on the paper side accompanied by little marking of the upper side as the points of alternation or intersections are evenly distributed.

18 Claims, 2 Drawing Sheets

PAPER MAKING WIRE CLOTH

FIELD OF THE INVENTION

The present invention relates to a papermaking wire cloth, particularly for the sheet forming zone, with a paper and a backing side. The wire cloth is made up of at least one type of cross-thread and at least one type of lengthwise thread interwoven with the former. The threads together form at least two different types of crossings. The weave pattern made up of the lengthwise and cross-threads of the paper side being repeated between crossings of the same kind and the lengthwise threads alternating from the backing side to the paper side and conversely to form the respective other type of crossing.

BACKGROUND OF THE INVENTION

A growing number of high-performance papermaking machines with speeds of up to 2000 meters per minute and working widths above 10 meters are used in the paper production industry today. The sheet forming unit is very generally designed as a double cloth former, and in many cases as a split former. Typically, the sheet forming process takes place immediately between two papermaking wire cloths in a relatively short drainage zone. The time required for sheet formation is reduced to milliseconds by this short distance and the high production rate. Over this interval the solid fraction or dry content of the fiber suspension must be increased from about 1 percent to about 20 percent. For the papermaking wire cloth, this requirement means that this machine must be characterized by very high drainage performance, without leaving markings in the paper, and must also provide high fiber support.

Another important point is the transverse stability of wire cloth tension. This stability is of decisive importance in determining the thickness and moisture profile of the sheet. Very strict requirements are set in this connection, particularly for modern machines characterized by large operating widths. To improve sheet formation, shaping strips are consequently used with increasing frequency in the sheet forming zone. The shaping strips are mounted alternately on the backing sides of the wire cloth and are pressed against these sides. The result is rapidly alternating load deflection of the cover of the wire cloths in the longitudinal direction.

Today, an effort is customarily made to meet these requirements by use of composite fabrics. A composite fabric used for this purpose is described in DE 42 29 828 C2, for example. The conventional papermaking wire cloth in question has two superposed wire cloth fabrics in the form of single layers interconnected by binding threads extending in the cross and/or lengthwise direction. One of the fabrics is in the form of definition fabric having the mechanical properties of the composite fabric with respect to extension. The other wire cloth fabric in the form of reaction fabric of higher tension and lower rigidity than the definition fabric. The wire cloth fabrics include warp threads and woof threads connected to each other by additional binding threads. As a result of the design of the cloth fabrics as reaction or definition fabrics, internal wear, especially wear of the binding threads, is resisted. In this way, the service life of the combination fabric is lengthened, and undesirable separation of the wire cloth fabric layer is prevented over a long period. The internal wear of a combination fabric is caused especially by the circumstance that, during redirection of the wire cloth, such as occurs in the area of guiding rollers of the wire cloth batch by way of which the combination fabric is guided, the individual wire cloth fabric layers are stretched or crushed to varying degrees.

Since the binding threads not only belong to the structure of the fabric but are independent components, they are kept as small as possible in diameter in order to disrupt drainage as little as possible. With correspondingly high stresses, the possibility exists that the thin binding threads will then break, and the connection between the wire cloth fabrics will be interrupted. In the case of a generic papermaking wire cloth, as disclosed in EP 0 432 413 B1, which also has the structure of a composite fabric, the proposal has already been made that binding threads be used as two fabric-specific threads and interlaced with the other fabric layer involved to form X-shaped crossings in order to prevent the disadvantages in the state of the art described. The accumulation alone of the known change points in the cross-direction also results unintentionally in stiffening of the conventional fabric. Considerable differences in length may occur especially over greater weaving lengths which, in turn, are manifested in difference in tension, with the result that fabric-specific binding threads break and may result in failure of the conventional papermaking wire cloth. It is also known in connection with this conventional special type of weave that it is more or less possible to produce only cross-threads of one kind, that is, cross-threads of more or less the same diameter, for both the upper and the lower fabric, something which reduces the possibility of efficient support on the backing side. In addition, manufacture of the conventional interlocking fabric is costly.

SUMMARY OF THE INVENTION

Objects of the present invention involve providing papermaking wire cloths having a longer service life available in papermaking and making the process more cost-effective.

The alternation of the lengthwise threads is accompanied by formation of another type of crossing within each repeat of the backing side. The cross-threads of the backing side are held by at a minimum of two lengthwise threads within this repeat of the backing side on its outer side facing away from the paper side. Maximum fiber support is achieved on the paper side, along with only slight marking of the upper side, since uniform distribution of the alternating or crossing points is achieved. Since layer binding in the lengthwise direction by all threads is present, unintentional layer separation is also prevented with high certainty.

As a result of support on the external side by way of at least two lengthwise threads of a repeat, it is additionally possible to select cross-threads for the backing side which are thicker than the cross-threads of the paper side and yet to ensure reliable support by these threads in the papermaking wire cloth. As a result, the support forces may be usefully increased and the drainage output correspondingly increased by relatively "open" backing side formed in this manner. Preferably, a woof ratio of 2:1 is to be chosen. In addition, the operating time potential for the papermaking wire cloth is maximized by the long-floating backing side with its wefts widened in cross-section. The high lateral stability is nevertheless achieved on the basis of the two separated woof layers.

Other objects, advantages and salient features of the present invention will become apparent from the following detailed description, which, taken in conjunction with the annexed drawings, disclose a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
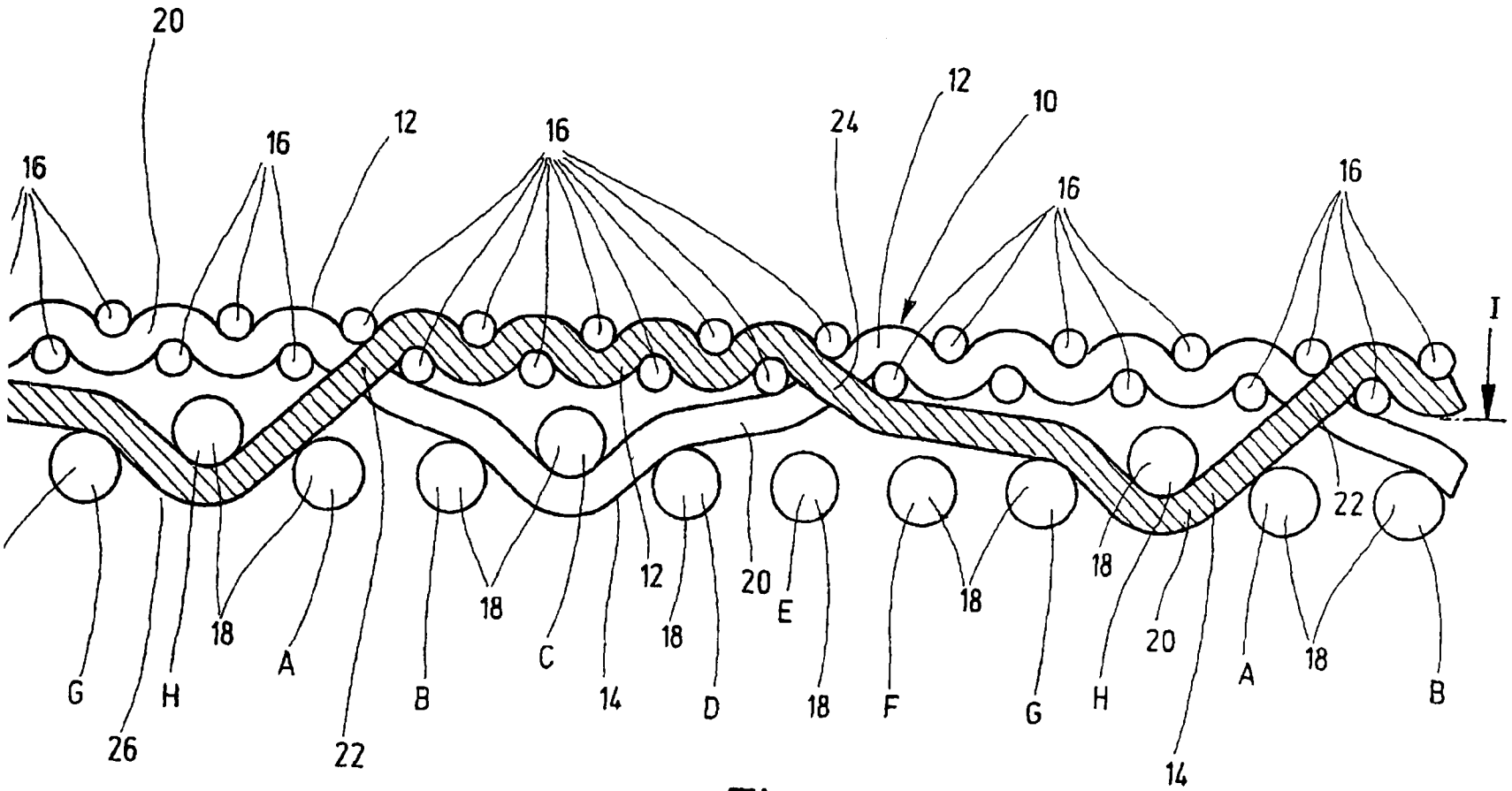
FIG. 1 is a partial side view in section of a papermaking wire cloth according to an embodiment of the present invention.

The drawings illustrate a part of a wire cloth fabric 10 for a papermaking wire cloth (not shown as a whole). It may be used in particular for the sheet forming zone in conventional papermaking machines. The wire cloth 10 has a paper side 12 and a backing side 14. The paper side 12 and backing side 14 are formed of two different types of cross-threads 16 and 18 extending in the cross machine direction, and at least one type of lengthwise thread 20 extending in the machine direction interwoven with them. The cross-threads 16 and 18 form, with the lengthwise threads 20 interwoven with them, in both the lengthwise and the cross directions, as viewed in the line of vision to the wire cloth fabric 10, eight-shank repeats A to H which are repeated correspondingly in the lengthwise and the cross directions. Two different types of X-shaped crossings 22 and 24 are formed within the wire cloth fabric 10 during formation of the repeats A to H (see FIG. 1). As is to be seen in FIG. 1, one lengthwise thread 20 of the same type extends at a crossing 22 of the same type in one direction, for example, with positive pitch, and with negative pitch at the crossing of the other type, 24 in this instance.

As the figures also show, the weave pattern made up of the lengthwise threads 20 and cross-threads 16 of the paper side 12 is repeated between crossings 22 of the same type. The lengthwise threads 20 alternate from the backing side 14 to the paper side 12 and vice versa between the two crossings 22 of the same type, and form the respective other type of crossings 24. Consequently, according to the present invention, that alternation of the lengthwise threads 20, in contrast with the state of the art, takes place within the particular repeat A to H of the backing side 14 to form the other type at crossings 24. In addition, as especially shown in FIG. 3, the cross-threads 18 of the backing side 14 are held by at least two lengthwise threads 20 within this repeat A to H of the backing side on its outer side 26 facing away from the paper side 12. The weave of the present invention permits doubling of the number of woofs on the paper side 12 relative to the backing side 14 shown. A woof ratio of 2:1 is accordingly obtained between paper side 12 and backing side 14. A woof ratio of only 1:1 is generally obtained with the conventional solutions.

The thread diameters which can thus be incorporated on the backing side 14 may in this way be doubled in cross-section relative to the paper side 16. This doubling of thread diameters in turn means that the volume of the material undergoing wear (ground), and accordingly the service life of the wire cloth of the present invention, may be increased considerably both by the long-floating weave and the greater diameter on the backing side 14. In addition, as a result of "open" backing side achieved, the permeability of the wire cloth fabric 10 is increased to distinctly improve the drainage properties. In the case of the papermaking wire cloth according to the present invention, all connecting lengthwise threads 20 are arranged in direct sequence. In contrast, with the conventional fabric solutions, there is no interposed face weft or face warp. The wire cloth fabric 10 of the present invention has a connection pattern largely homogenous in form and a reliable connection acting equally in each direction of the fabric. The weave pattern of the paper side 12 consists of a conventional linen weave which extends between crossings of one kind 22 and the immediately following other kind 24, which is of eight-shank configuration. Provision is also made such that the backing side 14 with each repeat A to H is of eight-shank configuration as viewed in both directions.

Figure 3:
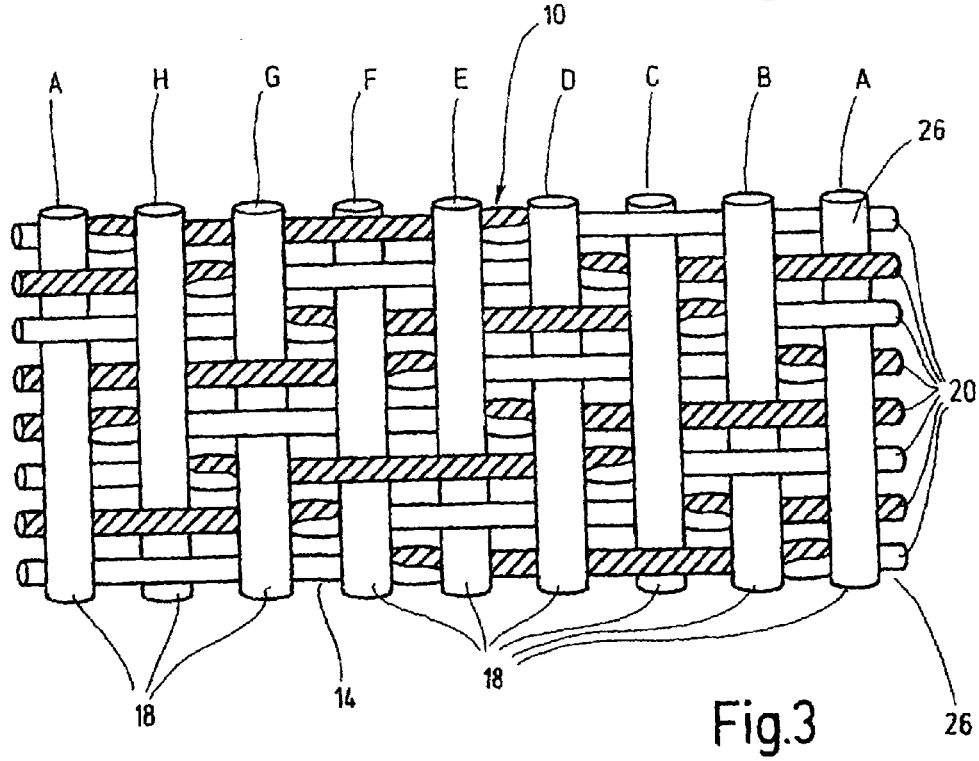
FIG. 3 is a bottom plan view in section of the backing side of the papermaking wire cloth of FIG. 1.

The respective lengthwise threads 20, which support the cross-threads 18 of the backing side 14 on its outer side 26 facing away from the paper side 12, are mounted so as to be adjacent to each other at least once in pairs (see FIG. 3). It has been found to be especially advantageous from the viewpoint of production technology for the cross-threads 16 and 18 to be in the form of woof threads and the lengthwise threads 20 in the form of warp threads. As is to be seen in FIG. 1 in particular, the crossings of one type 22 are supported on the backing side 14 by two cross-threads 18 and the crossing of the other type 24 by four cross-threads 18 as viewed in the direction of the backing side 14, these supporting cross-threads 18 being positioned more or less in one common plane on the outer side 26 of the backing side 14.

Figure 2:
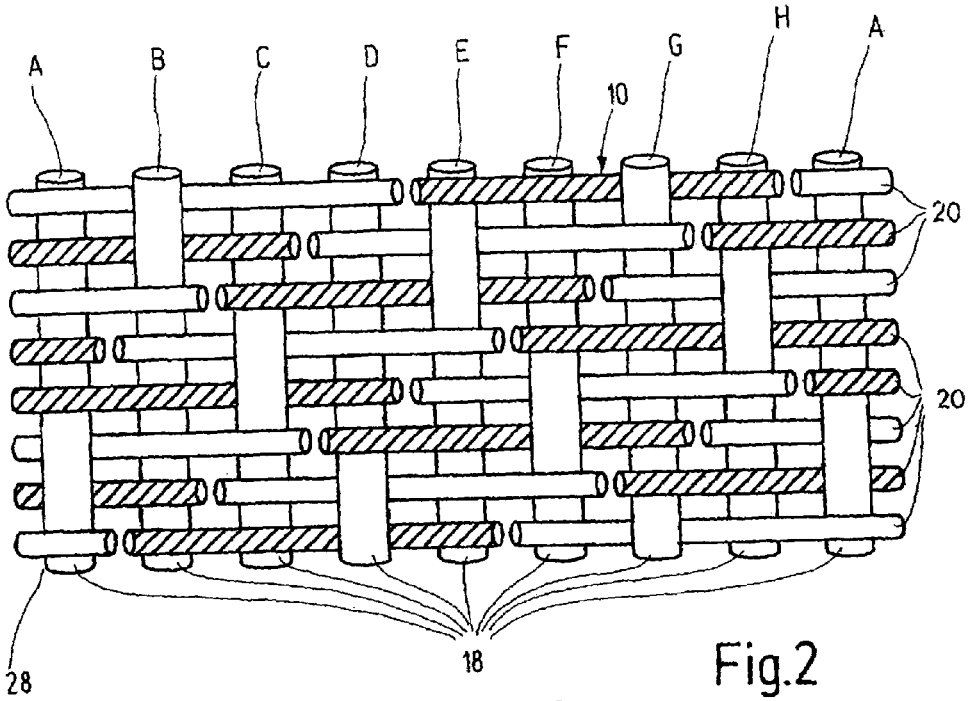
FIG. 2 is a top plan view in section of the backing side of the wire cloth of FIG. 1, taken along line I—I.

In addition, the respective lengthwise threads 20 which adjoin the cross-threads 18 of the backing side 14 on their side facing the paper side 28 (see FIG. 2) are grouped in pairs side by side; up to three groups may be joined immediately adjacent to each other within a repeat A to H (see cross-thread 18D in FIG. 2). A different, regularly repeated, weave pattern is also conceivable in this instance in place of the linen weave on the paper side 12. As a result of the equivalent bonding of paper side 12 and backing side 14, a unified texture is provided rather than, as in the state of the art, a composite fabric made up of individual fabrics separable from each other. The papermaking wire cloth is nevertheless multilayered in structure and could be correspondingly augmented to produce a composite fabric.

While various embodiments have been chosen to illustrate the invention, it will be understood by those skilled in the art that various changes and modifications can be made therein without departing from the scope of the invention as defined in the appended claims.

The invention claimed is:

1. A papermaking wire cloth for a sheet forming zone, comprising:

a paper side;

a backing side;

cross-threads making up said sides;

at least first lengthwise threads of at least one type interwoven with said cross-threads and forming at least first and second crossings while forming repeats, and first and second crossings being of different types; and a weave pattern formed of said cross-threads and said lengthwise threads of said paper side being repeated between consecutive ones of said first crossings and consecutive ones of said second crossings, said lengthwise threads alternating from said backing side to said paper side and vice versa between consecutive ones of said first crossings with the second crossing being formed and between consecutive ones of said second crossings with the first crossing being formed, said lengthwise threads alternating and being formed with a different one of said crossings within one repeat of said backing side, said cross-threads of said backing side being held within said one repeat of said backing side on an outer side thereof remote from said paper side by at least two of said lengthwise threads, said weave pattern on said paper side being a linen weave.

2. A papermaking wire cloth according to claim 1 wherein said linen weave extending between consecutive ones of said first and second crossings is formed of eight shanks.

3. A papermaking wire cloth according to claim 1 wherein said backing side is formed with eight shanks within each of said repeats thereof.

4. A papermaking wire cloth according to claim 1 wherein said cross-threads of said backing side are larger in transverse cross section than said cross-threads of said paper side.

5. A papermaking wire cloth according to claim 1 wherein said cross-threads are woof threads; and said lengthwise threads are warp threads.

6. A papermaking wire cloth according to claim 1 wherein each of said first and second crossing form an X.

7. A papermaking wire cloth for a sheet forming zone, comprising:

a paper side;

a backing side;

cross-threads making up said sides;

at least five lengthwise threads of at least one type interwoven with said cross-threads and forming at least first and second crossings while forming repeats, said first and second crossings being of different types; and a weave pattern formed of said cross-threads and said lengthwise threads of said paper side being repeated between consecutive ones of said first crossings and consecutive ones of said second crossings, said lengthwise threads alternating from said backing side to said paper side and vice versa between consecutive ones of said first crossings with the second crossing being formed and between consecutive ones of said second crossings with the first crossing being formed, said lengthwise threads alternating and being formed with a different one of said crossings within one repeat of said backing side, said cross-threads of said backing side being held within said one repeat of said backing side on an outer side thereof remote from said paper side by at least two of said lengthwise threads, side lengthwise threads supporting said cross-threads of said backing side on said outer side thereof being positioned at least once in pairs adjacent one another.

8. A papermaking wire cloth according to claim 7 wherein said lengthwise threads delimiting said cross-threads of said backing side on a side thereof facing away from said paper side are present in up to three groups, said cross-threads of said backing side being grouped in pairs with one thread of each pair being next to the other thread of each pair.

9. A papermaking wire cloth for a sheet forming zone, comprising:

a paper side;

a backing side;

cross-threads making up said sides;

at least first lengthwise threads of at least one type interwoven with said cross-threads and forming at least first and second crossings while forming repeats, said first and second crossings being of different types; and a weave pattern formed of said cross-threads and said lengthwise threads of said paper side being repeated between consecutive ones of said first crossings and consecutive ones of said second crossings, said lengthwise threads alternating from said backing side to said paper side and vice versa between consecutive ones of said first crossings with the second crossing being formed and between consecutive ones of said second crossings with the first crossing being formed, said lengthwise threads alternating and being formed with a different one of said crossings within one repeat of said backing side, said cross-threads of said backing side being held within said one repeat of said backing side on an outer side thereof remote from said paper side by at least two of said lengthwise threads, each of said first crossings being supported on said backing side by two of said cross-threads, each of said second crossings being supported on said backing side by four of said cross-threads, said cross-threads supporting said crossings being positioned in a common plane on said outer side.

10. A papermaking wire cloth for a sheet forming zone, comprising:

a paper side;

a backing side;

first and second cross-threads making up said paper and backing sides, respectively;

lengthwise threads of at least one type interwoven with said first and second cross-threads and forming at least first and second crossings while forming repeats, said first and second crossings being of different types; and a weave pattern formed of said first cross-threads and said lengthwise threads on said paper side being repeated between consecutive ones of said first crossings and consecutive ones of said second crossings, said lengthwise threads alternating from said backing side to said paper side and vice versa between consecutive ones of said first crossings with the second crossing being formed therebetween and between consecutive ones of said second crossins with the first crossing being formed therebetween, said lengthwise threads alternating and being formed with each different one of said crossings within one repeat of said backing side, said second cross-threads being held within said one repeat on an outer side of said backing side remote from said paper side by at least two of said lengthwise threads, said weave pattern on said paper side being a linen weave.

11. A papermaking wire cloth according to claim 10 wherein said linen weave extending between consecutive ones of said first and second crossings is formed of eight shanks.

12. A papermaking wire cloth according to claim 10 wherein said backing side is formed with eight shanks within each of said repeats thereof.

13. A papermaking wire cloth for a sheet forming zone, comprising:

a paper side;

a backing side;

first and second cross-threads making up said paper and backing sides, respectively;

lengthwise threads of at least one type interwoven with said first and second cross-threads and forming at least first and second crossings while forming repeats, said first and second crossings being of different types; and a weave pattern formed of said first cross-threads and said lengthwise threads of said paper side being repeated between consecutive ones of said first crossings and consecutive ones of said second crossings, said lengthwise threads alternating from said backing side to said paper side and vice versa between consecutive ones of said first crossings with the second crossing being formed therebetween and between consecutive ones of said second crossings with the first crossing being formed therebetween, said lengthwise threads alternating and being formed with each different one of said crossings within one repeat of said backing side, said second cross-threads being held with said one repeat on an outer side of said backing side remote from said paper side by at least two of said lengthwise threads, said lengthwise threads supporting said second cross-threads being positioned at least once in pair adjacent one another.

14. A papermaking wire cloth according to claim 10 wherein said second cross-threads are larger in transverse cross section than said first cross-threads.

15. A papermaking wire cloth according to claim 10 wherein said cross-threads are woof threads; and said lengthwise threads are warp threads.

16. A papermaking wire cloth according to claim 10 wherein each of said first and second crossings form an X.

17. A papermaking wire cloth according to claim 13 wherein said lengthwise threads delimiting said second cross-threads are present in up to three groups, said second cross-threads being grouped in pairs with one thread of each pair being next to the other thread of each pair.

18. A papermaking wire cloth for a sheet forming zone, comprising:

a paper side;

a backing side;

first and second cross-threads making up said paper and backing sides, respectively;

lengthwise threads of at least one type interwoven with said first and second cross-threads and forming at least first and second crossings while forming repeats, said first and second crossings being of different types; and a weave pattern formed of said first cross-threads and said lenghtwise threads on said paper side being repeated between consecutive ones of said first crossings and consecutive ones of said second crossings, said lengthwise threads alternating from said backing side to said paper side and vice versa between consecutive ones of said first crossings with the second crossing being formed therebetween and between consecutive ones of said second crossings with the first crossing being formed therebetween, said lengthwise threads alternating and being formed with each different one of said crossings within one repeat of said backing side, said second cross-threads being held within said one repeat on an outer side of said backing side remote from said paper side by at least two of said lengthwise threads, each of said first crossings being supported on said backing side by two of said second cross-threads each of said second crossings being supported on said backing side by four of said second cross-threads, said second cross-threads supporting said first and second crossings positioned in a common plane on said outer side.

* * * * *